US010392168B2

(12) United States Patent
Hanawa et al.

(10) Patent No.: US 10,392,168 B2
(45) Date of Patent: Aug. 27, 2019

(54) CONTAINER POURING SPOUT SEALING STRUCTURE

(71) Applicant: KOSE Corporation, Chuo-ku (JP)

(72) Inventors: Atsushi Hanawa, Tokyo (JP); Mamoru Orii, Miyagi (JP)

(73) Assignee: KOSE Corporation, Chuo-ku (JP)

( * ) Notice: Subject to any disclaimer, the term of this patent is extended or adjusted under 35 U.S.C. 154(b) by 0 days.

(21) Appl. No.: 15/749,925

(22) PCT Filed: Aug. 2, 2016

(86) PCT No.: PCT/JP2016/072586
§ 371 (c)(1),
(2) Date: Feb. 2, 2018

(87) PCT Pub. No.: WO2017/022736
PCT Pub. Date: Feb. 9, 2017

(65) Prior Publication Data

US 2018/0244442 A1 Aug. 30, 2018

(30) Foreign Application Priority Data

Aug. 3, 2015 (JP) ..... 2015-153211

(51) Int. Cl.
*B65D 39/16* (2006.01)
*B65D 47/12* (2006.01)
(Continued)

(52) U.S. Cl.
CPC ..... *B65D 47/36* (2013.01); *B65D 39/16* (2013.01); *B65D 47/121* (2013.01); *B65D 51/18* (2013.01);
(Continued)

(58) Field of Classification Search
CPC ..... B65D 47/36; B65D 39/16; B65D 51/20; B65D 2101/0023; B65D 2251/205; B65D 2517/0013
(Continued)

(56) References Cited

U.S. PATENT DOCUMENTS

RE29,850 E * 11/1978 Labarre ..... B65D 47/103 215/253
4,149,651 A * 4/1979 Ignell ..... B65D 39/16 215/354
(Continued)

FOREIGN PATENT DOCUMENTS

CN 102666284 A 9/2012
JP 37-6248 B1 6/1962
(Continued)

OTHER PUBLICATIONS

International Search Report dated Nov. 8, 2016, in PCT/JP2016/072586 filed Aug. 2, 2016.
(Continued)

*Primary Examiner* — Benjamin R Shaw
(74) *Attorney, Agent, or Firm* — Oblon, McClelland, Maier & Neustadt, L.L.P.

(57) ABSTRACT

A pouring spout sealing structure of an inside plug includes a sealing member including a bottom part for sealing an opening of a pouring spout of the inside plug, a peripheral wall rising from the peripheral edge of the bottom part, and a knob part extending from the peripheral wall, in which the sealing member is connected to the upper end of the opening of the pouring spout at the peripheral edge of the bottom part, the connected portion constitutes a thin part breakable by a certain pulling force, and the peripheral wall is inclined upwardly and outwardly from the opening of the pouring spout. The container pouring spout sealing structure achieves both sealability and easy opening properties,
(Continued)

reduces number of parts and manufacturing steps, and is applicable to small containers such as cosmetic containers.

4 Claims, 5 Drawing Sheets

(51) Int. Cl.
*B65D 47/36* (2006.01)
*B65D 51/18* (2006.01)
*B65D 51/20* (2006.01)

(52) U.S. Cl.
CPC ..... *B65D 51/20* (2013.01); *B65D 2101/0023* (2013.01); *B65D 2251/205* (2013.01); *B65D 2517/0013* (2013.01)

(58) Field of Classification Search
USPC ..... 222/153.07
See application file for complete search history.

(56) References Cited

U.S. PATENT DOCUMENTS 5,249,695 A * 10/1993 Luch ..... B65D 39/00 220/265
5,755,360 A * 5/1998 Elliott ..... B65D 47/103 222/153.07
5,810,207 A * 9/1998 Hayashida ..... B65D 41/485 215/237
6,082,568 A * 7/2000 Flanagan ..... B65D 51/20 215/232
6,116,441 A * 9/2000 Decelles ..... B65D 47/0838 215/237
9,963,263 B2 * 5/2018 Isogai ..... B65D 5/746
2004/0188465 A1 * 9/2004 Timmerman ..... B65D 47/36 222/145.5
2009/0145902 A1 * 6/2009 Krallmann ..... B65D 35/44 220/270
2016/0167849 A1 * 6/2016 Isogai ..... B65D 51/22 215/296
2016/0288967 A1 * 10/2016 Isogai ..... B65D 47/36

FOREIGN PATENT DOCUMENTS

JP 6-27610 U 4/1994
JP 10-59406 A 3/1998
JP 2002-166948 A 6/2002
JP 2006-124023 A 5/2006
JP 2006-248561 A 9/2006
JP 2007-39060 A 2/2007
JP 2008-13226 A 1/2008
JP 2011-016587 A 1/2011

OTHER PUBLICATIONS

Chinese Office Action issued in Chinese Application No. 201680045111.1 dated Jan. 8, 2019.

* cited by examiner

CONTAINER POURING SPOUT SEALING STRUCTURE

TECHNICAL FIELD

The invention relates to a container pouring spout sealing structure that seals a pouring spout using a sealing member when not used and opens the pouring spout by tearing and removing the sealing member when used in containers used for liquid cosmetics, liquid detergents, liquid eatables and drinkables, drugs, liquids, and the like.

BACKGROUND ART

There is a conventionally known inside plug, used for a container having a pouring spout from which content is poured, that seals the pouring spout with sealing means when not used and opens the pouring spout for the first time when used to ensure the virginity of a product. Food containers for dressing or sauce often adopt, as means for sealing the pouring spout of an inside plug, a so-called pull-ring type sealing member, which is molded integrally with the inside plug and opened by hooking a finger into the ring, pulling the ring, and tearing the thin border part with the inside plug body (PTL 1).

Although the conventional pull-ring type sealing member can be used for food containers having a relatively large size, the pull-ring type sealing member is not suitable for small containers such as cosmetic containers because, for example, the pull-ring cannot be accommodated in the space between the cap put on the neck part and the inside plug. Accordingly, another sealing member is proposed in which a small knob part that can be accommodated in the cap is provided in place of a pull-ring and the knob part is pulled to tear and open the sealing member (PTL 2). Since the pulling force applicable to a small knob part is smaller than that of a pull-ring, the part to be broken needs to be thinner so that the part can be opened with a small force. However, the conventional injection molding method has difficulty achieving both assurance of virginity and easy breakage in the thin part.

That is, when the thin part is too thin, an increase in the inner pressure of a container or an external pressing force may break the thin part, possibly losing virginity. In addition, when welds (junction marks generated in the confluence of molten resin) are generated in the thin part in the conventional injection molding, the thickness of the thin part may vary, possibly making it difficult to maintain sufficient airtightness and water-tightness.

However, when the thin part is thickened to ensure virginity and eliminate variations in injection molding due to welds, easy breakage is lost consequently and the thin part cannot be opened easily.

Accordingly, cosmetic containers or other containers perform sealing by pasting a hermetic seal (safety seal or virgin seal) as a separate member to the container pouring spout instead of adopting sealing means that tears and opens the sealing member (PTL 3).

However, such seal type sealing means has difficulty achieving both reliable sealing by a seal and easy removal. That is, when the adhesive strength (peeling strength) of a hermetic seal is increased to prevent the leakage of the content of a sealed container such as a skin toner, it is difficult to peel off the seal and results in inconvenience. Specifically, since cosmetic containers are used by women in many cases, if the peeling strength is increased, an attempt to peel off the hermetic seal may damage nails.

In addition, when the container pouring spout has a hermetic seal or the like which is made of a material different from that of the inside plug body, the hermetic seal and the inside plug body need to be formed as separate bodies and the process for adhering the inside plug to the hermetic seal is added, thereby causing a problem in that the cost becomes high and the number of manufacturing steps increases.

PTL 1: JP-A-2007-39060
PTL 2: JP-A-2002-166948
PTL 3: JP-A-2008-13226

SUMMARY OF INVENTION

Technical Problem

Accordingly, an object of the invention is to provide a container pouring spout sealing structure that overcomes such defects of the conventional container pouring spout sealing structure, achieves both sealability and easy opening properties, reduces the number of parts and manufacturing steps, and can be applied to a small container such as a cosmetic container.

Solution to Problem

The invention addresses the above problems with an object of providing a pouring spout sealing structure of an inside plug to be attached to a neck part of a container, the sealing structure including a sealing member including a bottom part that seals an opening of a pouring spout of the inside plug, a peripheral wall that rises from a peripheral edge of the bottom part, and a knob part that extends from the peripheral wall, in which the sealing member is connected to an upper end of the opening of the pouring spout at the peripheral edge of the bottom part, the connected portion constitutes a thin part breakable by a certain pulling force, and the peripheral wall is inclined upwardly and outwardly from the opening of the pouring spout.

In addition, the invention is the pouring spout sealing structure of an inside plug, in which the inside plug and the sealing member are injection-molded integrally with each other through at least one injection gate for the inside plug and at least one injection gate for the sealing member.

In addition, the invention is the pouring spout sealing structure of an inside plug, in which the inside plug and the sealing member are attachment-molded integrally with each other by a two-color molding method and the sealing member and the inside plug are surface-welded to each other through a planar part molded integrally with the sealing member via the thin part, the planar part constituting a part of the inside plug after welding.

Advantageous Effects of Invention

Since the peripheral wall of the sealing member is inclined upwardly and outwardly from the opening of the pouring spout in the pouring spout sealing structure of an inside plug according to the invention, when a pressing force is applied to the sealing member from above, the peripheral wall is distorted radially outwardly to absorb and distribute the pressing force from above, thereby preventing the thin part from being broken. In addition, since the peripheral wall is inclined toward the outer periphery from the opening of the pouring spout, the thin part can be prevented from being broken by the sealing member having being pushed into the pouring spout.

With respect to the pouring spout sealing structure of an inside plug according to the invention, when the inside plug and the sealing member are injection-molded integrally with each other through injection gates which are provided at least for the inside plug and the sealing member, respectively, occurrence of weld lines and airtight leakage can be prevented during injection molding because the two injection gates are provided.

In addition, in the pouring spout sealing structure of an inside plug according to the invention, when the inside plug and the sealing member are attachment-molded integrally with each other by a two-color molding method and the sealing member and the inside plug are surface-welded to each other through a planar part molded integrally with the sealing member via the thin part, the planar part constituting a part of the inside plug after the welding, welding failures and variations in the thickness are prevented from occurring during welding both surfaces via the thin part and the thin part having a thickness achieving both strength and easy breakage can be molded stably.

DESCRIPTION OF EMBODIMENTS

Figure 1:
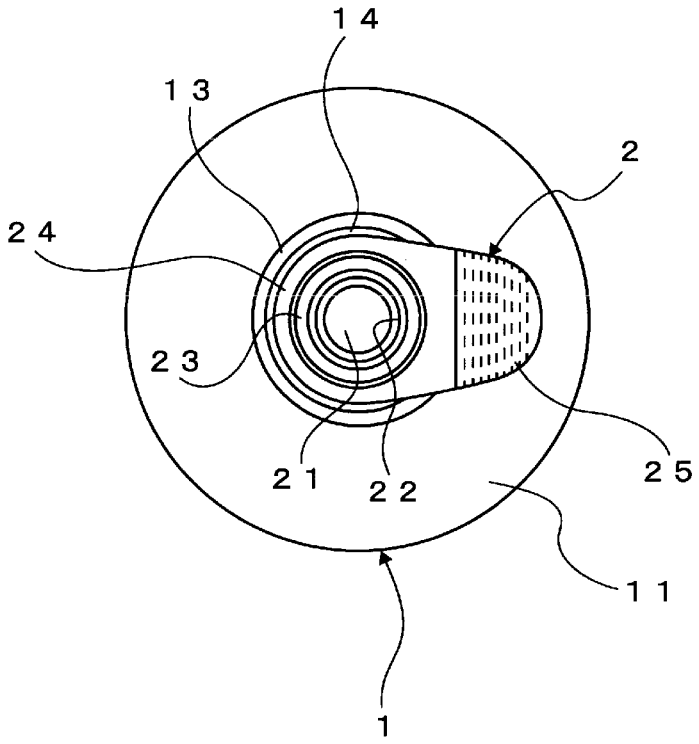
FIG. 1 is a plan view illustrating an inside plug in the state in which a pouring spout is sealed by a pouring spout sealing structure of an inside plug according to the invention.
Figure 2:
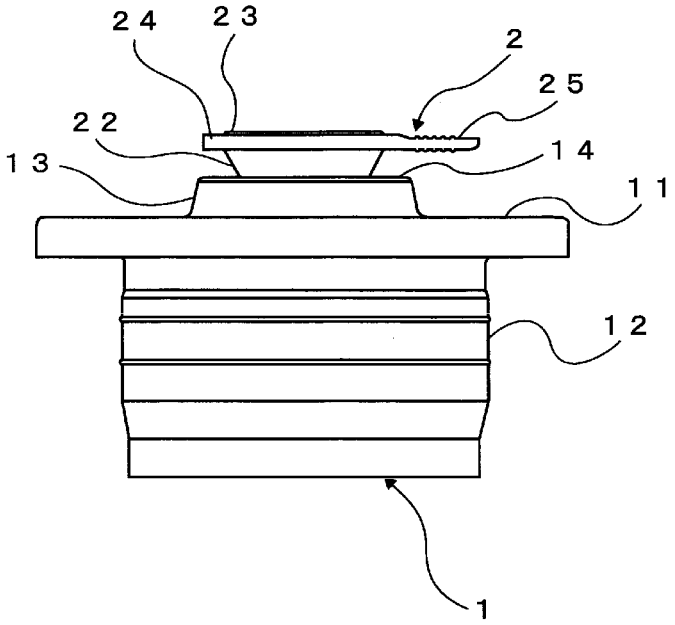
FIG. 2 is a front view illustrating the inside plug in the state in which the pouring spout is sealed by the pouring spout sealing structure of an inside plug according to the invention.

Embodiments of container pouring spout sealing structures according to the invention will be specifically described below with reference to the drawings. It should be noted that the invention is not limited to these embodiments.

The container pouring spout sealing structures according to the invention are applicable to an inside plug, attached to the neck part of a container, that has a general structure. In addition, the sealing structures surely hermetically seal a pouring spout of an inside plug, have a sealing member that can be teared and removed easily, and surely seal and open the pouring spout. Individual parts will be described in detail below.

As illustrated in the drawings, an inside plug 1 to which the container pouring spout sealing structure according to the invention is applied is the same as a general inside plug to be attached to the neck part of a container in the basic structure. That is, the inside plug 1 includes an upper wall 11 formed in a shape capable of sealing an opening 41 of a container neck part 4 to which the inside plug 1 is attached, a cylindrical wall 12 extending vertically downward from the upper wall 11, a projecting part 13 projecting upward from the upper surface thereof provided at the center of the upper wall 11, and a pouring spout 15 passing through the upper wall 11 from the front surface to the back surface provided at the center of the projecting part 13.

The projecting part 13 projects from the upper surface of the upper wall 11 by a predetermined height. The projecting part 13 is preferably provided to prevent a drop of dips of the content when the content of the container to which the inside plug 1 is attached is discharged from the pouring spout 15. Although the embodiment has the projecting part 13, the projecting part 13 does not need to be provided for the container pouring spout sealing structure according to the invention and the upper wall 11 around the pouring spout 15 may be flat uniformly.

The inside plug 1 is fixed and held by inserting the cylindrical wall 12 into the opening 41 of the container neck part 4 to which the inside plug 1 is attached and closely fitting the cylindrical wall 12 to the inner wall of the neck part. The method for attachment to the container neck part 4 is not limited to this method and other known methods such as screwing or bonding may be used. Although the embodiment has the cylindrical wall 12 for attachment to the container neck part 4, the cylindrical wall 12 may be omitted and a peripheral wall 16 extending vertically downward from the peripheral edge of the upper wall 11 may be provided and fitted onto the outer peripheral wall of the container neck part 4 to fix the inside plug 1.

The pouring spout 15 is sealed by a sealing member 2 before use and opened by removing the sealing member 2 during use so that the content of the container can be poured.

Figure 6:
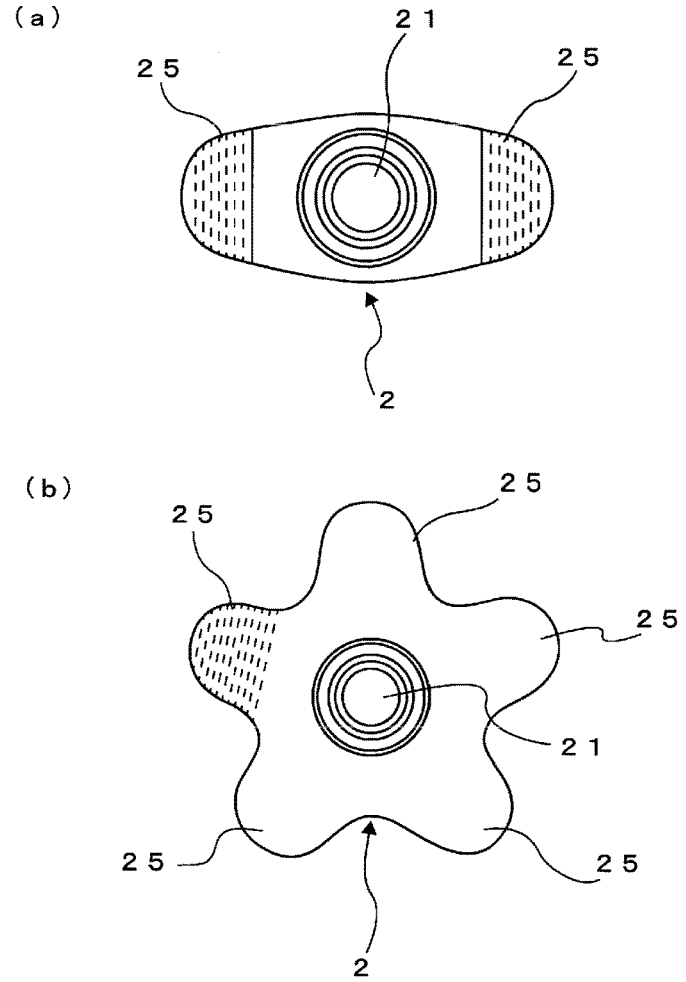
FIG. 6(*a*) is a sealing member of the pouring spout of the inside plug according to an embodiment of the invention, (*b*) is a sealing member of the pouring spout of the inside plug according to an embodiment of the invention.

The sealing member 2 is formed in a bottomed dish, includes a bottom part 21 formed so as to seal the opening of the pouring spout 15, a peripheral wall 22 rising from the peripheral edge of the bottom part 21, and a flange 24 extending substantially horizontally from the upper part of the peripheral wall 22, and a part of the flange 24 extends in this way to form a knob part More specifically, the bottom part 21 of the sealing member 2 is formed in a circular plate having substantially the same shape as the opening of the pouring spout 15 of the inside plug 1 and the peripheral wall 22 obliquely rises from the peripheral edge of the bottom part 21 toward the outer periphery of the inside plug 1. The upper end of the peripheral wall 22 forms an upper end convex part 23 projecting upward and the flange 24 extends substantially horizontally from the part of the outer peripheral part of the peripheral wall 22 a little lower than the upper end convex part 23. Part of the flange 24 further extends toward the outer periphery of the inside plug 1 to form the tongue-like knob part 25. Although the knob part 25 extends in only one direction from the flange 24 in the embodiment, the knob part 25 may extend in multiple directions, for example, the knob part 25 may extend symmetrically in two directions from the bottom part 21 as the center (FIG. 6(*a*)), or the knob part 25 may extend radially in the multiple directions from the bottom part 21 as the center (FIG. 6(*b*)).

Figure 4:
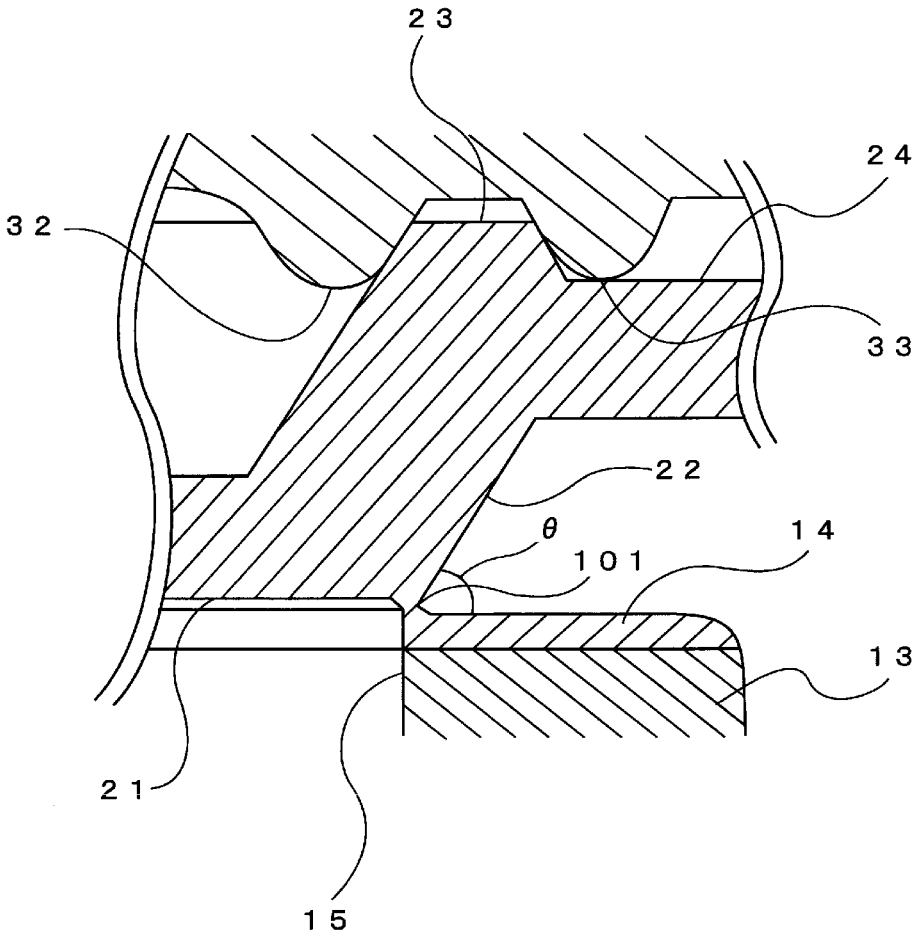
FIG. 4 is a partial enlarged view illustrating the inside plug having the cap thereon in the state in which the pouring spout is sealed by the pouring spout sealing structure of an inside plug according to the invention.

As illustrated in FIG. 4, the sealing member 2 is connected to the upper end of the opening of the pouring spout 15 of the inside plug 1 at the outer peripheral edge of the bottom part 21. A thin part 101 thinner than other parts of the sealing member 2 is formed in this connected portion. The thin part 101 is preferably formed to have a thickness that allows the thin part 101 to be broken by the smallest possible pulling force when the sealing member 2 is opened and the pouring spout 15 to be surely sealed in the state in which the sealing member 2 is not opened. Specifically, the thinnest part of the thin part 101 has a thickness t of preferably 0.03 mm to 0.1 mm, more preferably 0.05 mm to 0.07 mm.

In addition, the peripheral wall 22 of the sealing member 2 is inclined upwardly and outwardly from the opening of the pouring spout 15. By inclining the peripheral wall 22 upwardly and outwardly from the opening of the pouring spout 15 as described above, even if an impact is applied to the sealing member 2 from above due to a drop or the like or the sealing member 2 is pushed by a cap or the like from above, the peripheral wall 22 is distorted toward the outer periphery to absorb and distribute the pressing force in the lower direction, thereby preventing the thin part 101 from being broken.

In addition, since the peripheral wall 22 is inclined outwardly from the opening of the pouring spout 15, it is possible to prevent the sealing member 2 from being pushed into the pouring spout 15. This can prevent the thin part 101 from being broken by the sealing member 2 having being pushed into the pouring spout 15. The peripheral wall 22 has an inclination angle θ of preferably 20 degrees to 80 degrees, more preferably 30 degrees to 70 degrees.

Although the inclination angle of the peripheral wall 22 may be uniform from the upper part to the lower part of the peripheral wall 22, the inclination angle may be different between the upper part and the lower part of the peripheral wall 22. For example, the inclination angle θ may range from 20 degrees to 80 degrees in the lower part of the peripheral wall from the lower end to an arbitrary height and the inclination angle θ may be smaller or larger than the lower part of the peripheral wall in the upper part of the peripheral wall from the arbitrary height to the upper end. It should be noted that the inclination angle of the upper part of the peripheral wall maybe 90 degrees. That is, the upper part of the peripheral wall may be provided substantially orthogonally.

The inside plug 1 and the sealing member 2 of the container pouring spout sealing structure according to the invention may be molded integrally with each other using the same material. Generally, in the injection molding of synthetic resin, the molten resin injected from the nozzle of an injection molding machine finally passes through an inflow port referred to as a gate and fills individual cavities. Although junction marks (weld lines) may be formed at the confluence of molten resin in such injection molding, they are not preferable because they impair the appearance and strength of a product. If weld lines are generated particularly in the thin part 101 through which the inside plug 1 is connected to the sealing member 2 in the container pouring spout sealing structure according to the invention, airtight leakage may occur in this part and this is not preferable in terms of virginity.

Accordingly, when the inside plug 1 and the sealing member 2 according to the invention are injection-molded integrally with each other, it is preferable to provide at least one injection gate for each of the inside plug 1 and the sealing member 2. By providing the at least two injection gates as described above, occurrence of weld lines and airtight leakage can be prevented during injection molding.

In addition, the inside plug 1 and the sealing member 2 of the container pouring spout sealing structure according to the invention may be attachment-molded integrally with each other by a so-called two-color molding method. In the molding by the two-color molding method, the inside plug 1 and the sealing member 2 are injection-molded using different metal molds and then are attached to each other. However, in this case, it is preferable to weld the inside plug 1 and the sealing member 2 with each other through a planar part molded integrally with the sealing member 2 via the thin part 101, the planar part constituting a part of the inside plug 1 after the welding, as described below, instead of attaching the inside plug 1 and the sealing member 2 to each other through the thin part 101. It should be noted that the "planar part" represents a flat part, having a certain area large enough for surface-welding to the inside plug 1.

FIG. 4 is a partial enlarged view illustrating an embodiment of the inside plug 1 and the sealing member 2 formed by the two-color method. The sealing member 2 in the embodiment is molded integrally with the planar part constituting a part of the inside plug 1. Specifically, the sealing member 2 is molded integrally with the planar part (that is, an upper wall part 14 of the projecting part 13 in the embodiment) connected to the thin part 101 and having a certain thickness around the pouring spout 15. On the other hand, the inside plug 1 has the projecting part 13 formed in a position lower than the upper wall part 14 by the thickness of the upper wall part 14 formed integrally with the sealing member 2. When the inside plug 1 and the sealing member 2 are attached to each other, the lower surface of the upper wall part 14 formed integrally with the sealing member 2 is welded to the upper surface of the projecting part 13 of the inside plug 1.

The "planar part" to be surface-welded to the inside plug 1 only needs to have an area large enough for surface-welding to the inside plug 1 and to be formed integrally with the sealing member 2 via the thin part 101. Although the entire upper wall part 14 is equivalent to the "planar part" in the embodiment, for example, the "planar part" may be the part of the upper wall part 14 that is connected to the thin part 101. In addition, for the inside plug 1 not having the projecting part 13, the "planar part" to be welded to the inside plug 1 may be the part of the upper wall 11 that is connected to the thin part 101.

Since the inside plug 1 and the sealing member 2 are welded to each other via the surface of the projecting part 13 and the surface of the upper wall part 14 as described above, reliable attachment can be obtained. In addition, since the thin part 101 having the thinnest thickness is molded integrally with the sealing member 2 and the upper wall part 14, welding failures and variations in the thickness are reduced as compared with the welding via the thin part 101 and the thin part 101 having a thickness achieving both strength and easy breakage can be molded stably.

When the inside plug 1 and the sealing member 2 of the sealing structure of the container pouring spout according to the invention are formed by the two-color molding method, the inside plug 1 and the sealing member 2 may be made of different materials. In contrast, when the inside plug 1 and the sealing member 2 are made of the same material, the inside plug 1 and the sealing member 2 may have the same color. However, when the inside plug 1 and the sealing member 2 have different colors, the user can distinguish the sealing member 2 from the inside plug 1 more clearly.

Figure 3:
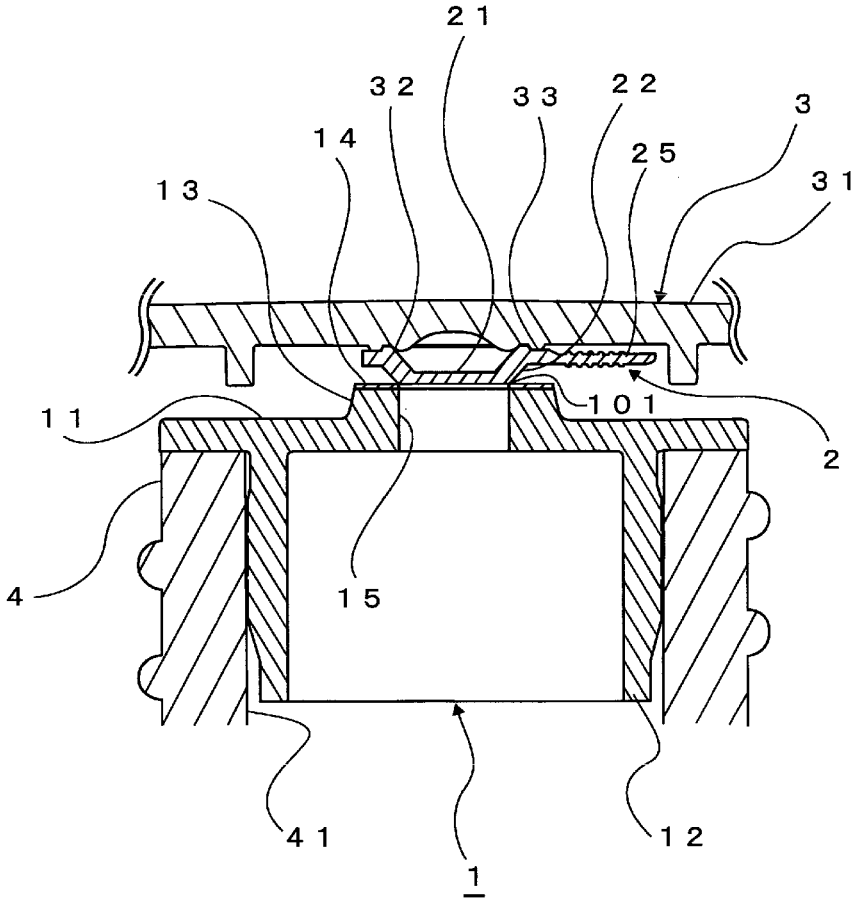
FIG. 3 is a cross sectional view illustrating the inside plug having a cap thereon in the state in which the pouring spout is sealed by the pouring spout sealing structure of an inside plug according to the invention.

The opening method for the inside plug 1 and the sealing member 2 of the container pouring spout sealing structure according to the invention will be described. As illustrated in FIGS. 3 and 4, in the state in which a cap 3 is put on the container neck part 4 and the sealing member 2 is not open, the upper end convex part 23 of the peripheral wall 22 is accommodated between annular ribs 32 and 33 provided on the back surface of an upper wall 31 of the cap 3. These ribs press the sealing member 2 with a certain force from above to prevent the thin part 101 from being broken even if the inner pressure of the container rises suddenly and the inner pressure presses the sealing member 2 upward from the inside.

In order to open the sealing member 2, the knob part 25 is held by a finger in the state in which the cap 3 is removed. Then, the end of the knob part 25 is pulled and lifted upward while the knob part 25 is held by a finger to cause the pulling force to concentrate on the part of the thin part 101 close to the knob part 25. Then, when an upward pulling force is further applied to the knob part 25, the thin part 101 starts breaking in a part of the thin part 101, the breakage leads to another part of the thin part 101 when application of the pulling force continues, and the entire thin part 101 breaks finally, so that the sealing member 2 can be removed from the inside plug 1. Now, the pouring spout 15 has been opened.

Figure 5:
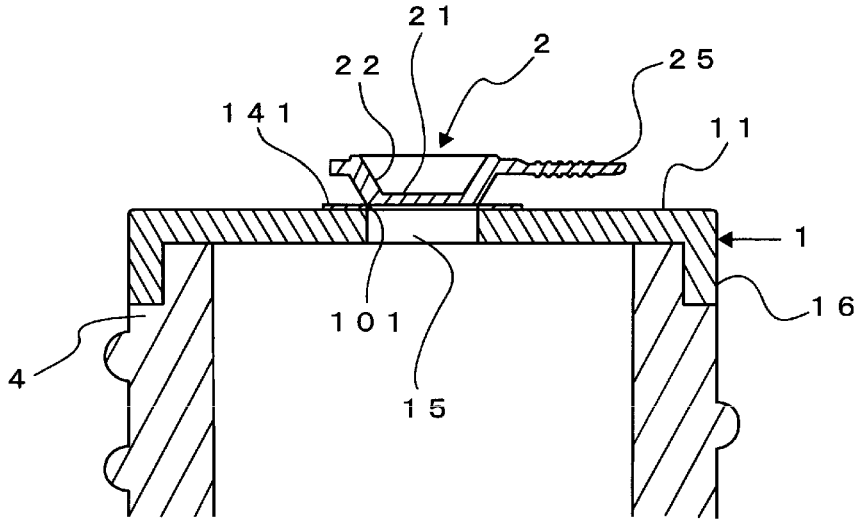
FIG. 5 is a cross sectional view illustrating an inside plug in the state in which a pouring spout is sealed by a pouring spout sealing structure of an inside plug according to another embodiment of the invention.

FIG. 5 illustrates the container pouring spout sealing structure according to the invention and is a cross sectional view of the inside plug 1 and the sealing member 2 according to another embodiment of the invention formed by the two-color molding method. In the inside plug 1 in the embodiment, the cylindrical peripheral wall 16 extending vertically downward from the peripheral edge of the upper wall 11 is put onto and fixed to the outer peripheral wall of the container neck part 4. The upper wall 11 is flat and the sealing member 2 is welded to the inside plug 1 at a part of the upper wall 11. Specifically, a planar part 141 connected integrally with the thin part 101 is formed so as to cover the region around the pouring spout 15 and the sealing member 2 is welded to the inside plug 1 via the planar part 141.

Figure 7:
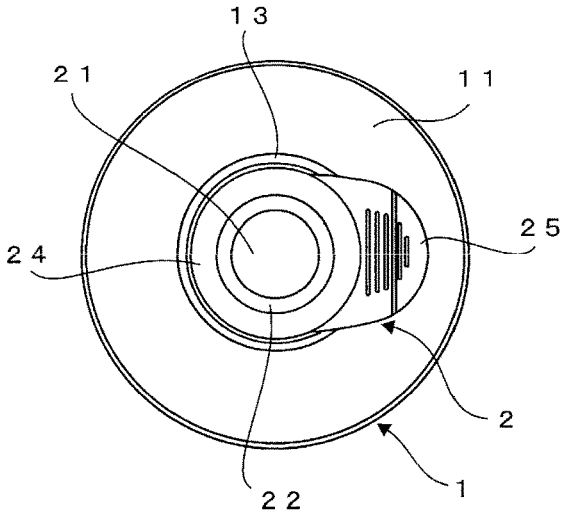
FIG. 7 is a plan view illustrating the inside plug sealed by a pouring spout sealing structure of an inside plug according to another embodiment of the invention.
Figure 8:
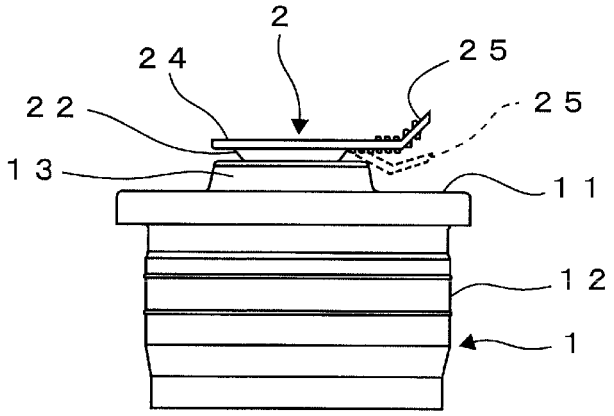
FIG. 8 is a front view illustrating the inside plug sealed by the pouring spout sealing structure of an inside plug according to another embodiment of the invention.

FIGS. 7 and 8 illustrate the inside plug 1 and the sealing member 2 of a container pouring spout sealing structure according to another embodiment of the invention. The sealing structure according to this embodiment is different from that of the embodiment in FIGS. 1 to 6 in that the end of the knob part 25 is bent obliquely upward. That is, when the knob part 25 extends horizontally as illustrated in FIGS. 1 to 6, the knob part 25 cannot be easily held by a finger or the knob part 25 has difficulty being held by a finger to open the sealing member 2 because the rib 33 and the like press down and bent the knob part 25 in the state in which the cap 3 is put on the inside plug 1 and not opened and the knob part 25 remains bent and has the tendency even after the cap 3 is opened or a part of the knob part 25 is attached to the upper wall 11. However, when the end of the knob part 25 is bent upward in advance as in the embodiment, since the end of the knob part 25 is oriented upward (dashed line in FIG. 8) even if the knob part 25 is bent downward, the end of the knob part 25 can be easily held by a finger even when the knob part 25 has a bent tendency, eliminating the possibility that the knob part 25 makes contact with the upper wall 11.

The inside plug 1 and the sealing member 2 of the container pouring spout sealing structure according to the invention may be made of the same material or different materials and may be made of, for example, various types of synthetic resin such as polyolefin resin (such as polypropylene or polyethylene), polyethylene terephthalate, regenerated polyethylene terephthalate, polyethylene naphthalate, polystyrene, acrylonitrile-styrene copolymer, acrylonitrile-butadiene-styrene copolymer, polycarbonate, polyamide resin (such as nylon), polyacetal resin (POM), or acrylic resin, or a combination of these types of resin. In particular, polypropylene and polyethylene are preferable among these types of resin.

REFERENCE SIGNS LIST

1: inside plug
2: sealing member
3: cap
4: container neck part
11: upper wall
12: cylindrical wall
13: projecting part
14: upper wall part
15: pouring spout
16: peripheral wall
21: bottom part
22: peripheral wall
23: upper end convex part
24: flange
25: knob part
31: upper wall
32: rib
33: rib
41: opening
101: thin part
141: planar part

The invention claimed is:

1. A pouring spout sealing structure of an inside plug to be attached to a neck part of a container, the sealing structure comprising:

a sealing member including a bottom part that seals an opening of a pouring spout of the inside plug, a peripheral wall that rises from a peripheral edge of the bottom part, and a knob part that extends from the peripheral wall, wherein the sealing member is connected to an upper end of the opening of the pouring spout at the peripheral edge of the bottom part, a connected portion constituting a thin pan breakable by a certain pulling force, the sealing member is welded to the inside plug through a planar part molded integrally via the thin part, and the peripheral wall is inclined upwardly and outwardly from the opening of the pouring spout and is inclined at an angle θ from 20 degrees to 80 degrees with respect to the planar part.

2. The pouring spout sealing structure of an inside plug according to claim 1, wherein the thin part has a thickness t from 0.03 mm to 0.1 mm.

3. The pouring spout sealing structure of an inside plug according to claim 1, wherein an end side of the knob part is bent obliquely upward.

4. The pouring spout sealing structure of an inside plug according to claim 2, wherein an end side of the knob part is bent obliquely upward.

* * * * *